US007093398B2

(12) United States Patent
Spransy et al.

(10) Patent No.: US 7,093,398 B2
(45) Date of Patent: Aug. 22, 2006

(54) WALL PANEL ASSEMBLY AND METHOD OF ASSEMBLY

(75) Inventors: Peter J. Spransy, Salt Lake City, UT (US); Ronald H. Bushman, Salt Lake City, UT (US); Donald A. Kugath, Draper, UT (US)

(73) Assignee: DAW Technologies, Inc., Salt Lake City, UT (US)

( * ) Notice: Subject to any disclaimer, the term of this patent is extended or adjusted under 35 U.S.C. 154(b) by 0 days.

(21) Appl. No.: 10/077,359

(22) Filed: Feb. 15, 2002

(65) Prior Publication Data

US 2003/0154672 A1 Aug. 21, 2003

(51) Int. Cl.
*E04B 2/14* (2006.01)

(52) U.S. Cl. ..... 52/586.2; 52/239; 52/240; 52/243.1; 52/585.1; 52/587.1; 160/351; 160/369; 403/363

(58) Field of Classification Search ..... 52/239, 52/240, 243.1, 585.1, 587.1, 586.2; 160/351, 160/369; 403/363
See application file for complete search history.

(56) References Cited

U.S. PATENT DOCUMENTS 3,082,849 A * 3/1963 Keller ..... 52/475.1
3,570,205 A * 3/1971 Payne
3,665,666 A * 5/1972 Delcroix ..... 52/461
4,059,933 A * 11/1977 Funk et al. ..... 52/127.12
4,106,255 A * 8/1978 Eckel ..... 52/586.1
4,128,983 A * 12/1978 Matsubara ..... 52/731
4,129,973 A * 12/1978 Keller ..... 52/308
4,497,148 A * 2/1985 Lopez ..... 52/126.3
5,325,649 A * 7/1994 Kajiwara ..... 52/582
6,230,385 B1 * 5/2001 Nelson ..... 29/450
6,430,880 B1 * 8/2002 Kemeny ..... 52/71
6,662,512 B1 * 12/2003 Westphal ..... 52/204.5

* cited by examiner

*Primary Examiner*—Carl D. Friedman
*Assistant Examiner*—Yvonne M. Horton
(74) *Attorney, Agent, or Firm*—TraskBritt, P.C.

(57) ABSTRACT

A wall assembly includes at least two panel elements which are configured for contiguous placement adjacent to one another. Each of the panel elements defines a hollow internal passageway. The panels are configured to permit a contiguous placement whereby the respective passageways of the panels are brought into registration with one another. A connection element is positioned within one of the passageways. The connection element is accessible through a slot defined within the sidewall of the panel wherein the connection element resides. The connection element is slidable whereby it may be displaced partially into the second panel element. The connection element is thereafter actuatable whereby its lateral dimension is increased to form a pressure fit union with the interior sidewalls of the two passageways. In its spatially expanded configuration, the connection element provides a means of interconnecting the two panel elements together.

20 Claims, 9 Drawing Sheets

WALL PANEL ASSEMBLY AND METHOD OF ASSEMBLY

BACKGROUND OF THE INVENTION

1. Field

This invention relates to assemblies of panel elements and methods for their assembly. More specifically, the invention is directed to an assembly of panels which may be utilized to form a wall or other structural member together with methods of constructing same.

2. State of the Art

Various structural constructions are formed by the interconnection of various smaller structural elements. While an integral structure may present certain structural advantages, oftentimes the limitations in manufacturing and handling techniques and capabilities dictate that a structure may only be constructed by manufacturing smaller elements and thereafter associating those elements one with another to construct the large structure. Furthermore, the limitations imposed by transportation of the finished structure also in part determine the approach to be taken in constructing a large structural construction.

The construction of a wail assembly is one example wherein such constraints are evident. For example in the construction of wall assemblies for rooms designed for manufacturing computer componentry, hereinafter "clean rooms", the wall assemblies must oftentimes exceed fourteen feet in height. Conventional manufacturing equipment for fabricating the elements of such rooms, e.g. metal bending presses, is typically suited for forming structures having a maximum height or length of much smaller dimensions, e.g. twelve feet. It follows that such wall assemblies are typically constructed of a number of individual elements which are associated together to form the desired dimensioned wall assembly.

Due to the specialized use of the room, unconventional building techniques are oftentimes utilized to construct such rooms. For example, presently clean room walls are manufactured using "panel on stud", construction. This type of construction uses a considerable number of individual parts to fabricate the various connections and joints which form part of a conventional wall assembly. Due to the requirement for very low particulates within the room, all panel joints require batten closures to be positioned on both sides of the wall. The need for such closures further increases the number of wall components and hardware required for a conventional construction.

Present construction techniques create several significant problems for clean room construction and maintenance. Oftentimes, clean rooms are constructed with an open grate flooring system. During the construction phase of a clean room, small components of the clean room may inadvertently be dropped onto the floor system. This typically results in the components falling through the floor and out of reach of the installer. Not only is this very inconvenient but furthermore in some instances this can be hazardous.

Due to the potential revenue of an operating clean room, the room must be constructed to ensure minimal downtime. A principal cause for downtime is routine cleaning. Rooms having edges or other surfaces which collect particulates, such as dust, can increase the time required for cleaning operations. Batten closures are recognized as creating cleaning problems in view of their creating surfaces on which dust may collect.

In conventional clean rooms the upright walls of the room are typically formed of two or more vertically positioned panels, one atop the other. The uppermost panel is oftentimes installed first by hanging it from a preformed ceiling structure. Thereafter, equipment to be housed in the room is installed and only then is the remainder of the wall constructed around the installed equipment. It should be appreciated that in many of these installations, the wall is formed around the perimeter of the equipment with many pieces of equipment actually extending through the wall itself.

In rooms of the height mentioned, being composed of multiple panels, serious problems are created with regard to the structural integrity of the wall system itself. The interconnection of two or more panels extending over such a height oftentimes results in a wall system having a tendency to bend or otherwise deflect from a vertical orientation. Prior efforts to rectify this problem have included the placement of reinforcement batons over the various joints of adjacently positioned panels. The use of these elongate reinforcement batons has not been altogether satisfactory. First, the batons are time consuming to install in that each joint must be measured and a respective batons cut to order to meet the particular measurements of a particular joint. Secondly, the batons have oftentimes proven less than satisfactory in providing the desired degree of structural integrity to the joint. Lastly surface mounted stiffeners are often unattractive and they create shelves for particulate (dust) to collect on—a feature that is unacceptable in a clean room.

There exists a need for a wall assembly for use in clean room construction which avoids or resolves the various problems identified above. Specifically, it is envisaged that a wall assembly system with fewer loose parts, having a simplified installation procedure would provide a significant advantage in the industry. Furthermore there continues to exist a need for a means of structurally enhancing the joints between adjacently positioned panels in a wall assembly. This need is most apparent in the environment of wall assemblies designed for use in a vertically upright position.

SUMMARY OF THE INVENTION

A wall panel assembly of the instant invention, in its most fundamental construction, includes a first panel and a second panel. Each of the first and second panels defines a respective hollow passageway. The panels are constructed to permit the positioning of one panel adjacent to the other panel. In an assembled condition, the passageways of the adjacently positioned first and second panels are disposed in registration or alignment with one another. The first panel defines a slot therein which communicates with the passageway defined within that panel. A connection member is provided for interconnecting the two panels one to another. Prior to the interconnection of the two panels, the connection element is typically housed within the passageway of the first panel. Once the two panels are positioned adjacent one another, the connection element may be slidingly displaced into the passageway of the second panel whereby the connection element is simultaneously positioned in the passageways of both panels. In this orientation, the connection member is partially housed within the first panel and partially housed within the second panel to form a linkage or bridging element between the two panels. The connection element is configured to be dimensionally expandible within the passageway to effect a pressure fit with the sidewalls of the passageway of the first panel. In preferred constructions the connection element is configured to expand laterally. The creation of this pressure fit causes the connection element to be retained, releasably in place within the passageway of the first panel and furthermore, this fit generally positions the connection element at a desired location within the passageway of the second panel. In some embodiments, the sidewall forming the passageway of the second panel is fitted with structure to form a pressure fit or other interconnection with the connection member as that connection element is inserted into the aforesaid passageway.

The connection element may be formed of two or more structural members. These structural members may be interrelated by a first interconnection member which is operative to adjust the spatial disposition of one structural member relative to the other. By adjusting the first interconnection member, the user is able to cause the two structural members to be displaced outward from one another effectively expanding the lateral dimensions of the connection element. This lateral expansion facilitates the formation of the pressure fit union of the connection element with the passageway sidewall referenced above.

The first interconnection member is physically accessible through the slot defined in the first panel. Irrespective of the placement of the first interconnection member within the passageways of the two panels, the user may access the first interconnection member for means of either creating the pressure fit union or disengaging that union.

The described panel construction permits the construction of a wall panel by first hanging the first wall panel from a preformed ceiling structure. Subsequent to the hanging of the first wall panel, the user may then position the second panel elevationally below the first panel and align the respective passageways of the two panels. It should be understood that in these initial installation procedures, the connection member is preferably secured within the passageway of the first panel. Upon securing the alignment of the two passageways, the user may thereafter release the connection element by physically accessing the interconnection member through the slot in the first wall panel. As the connection element is released, it falls under the force of gravity to a position wherein a first portion of the connection element is retained within the passageway of the first panel and a second portion of the connection element is retained within the passageway of the second wall panel. In preferred constructions, the passageway of the second panel is constructed whereby as the connection element enters that passageway, a pressure fit is created by the sidewall of the passageway with the exterior surface of the connection element. With the connection element in its desired location, the user may then expand the connection element by further actuation of the interconnection member. As the connection element is expanded it forms a pressure fit with the sidewall of the passageway of the first panel. With the creation of the two pressure fits with the respective sidewalls of the two wall panels, the connection element forms a secure interconnection between the two wall panels. The slot in the first panel may thereafter be covered by means of a releasably configured cover panel.

In the event that the user wishes to disassemble the wall assembly, the cover panel is first removed. Thereafter, the connection element is reconfigured to a configuration having a smaller width by actuating the first interconnection member. With the spatial reduction of the connection element, the user may thereafter force the connection element upward into the passageway of the first wall panel eventually removing that element from the passageway of the second wall panel. By actuating the first interconnection member and expanding the connection element, the connection element is fixed in the upward position to facilitate removal of the second wall panel. With the connection element removed from its association with the second panel, that panel is now free to be removed from its positioning relative to the first panel.

DETAILED DESCRIPTION OF THE ILLUSTRATED EMBODIMENTS

Figure 1:
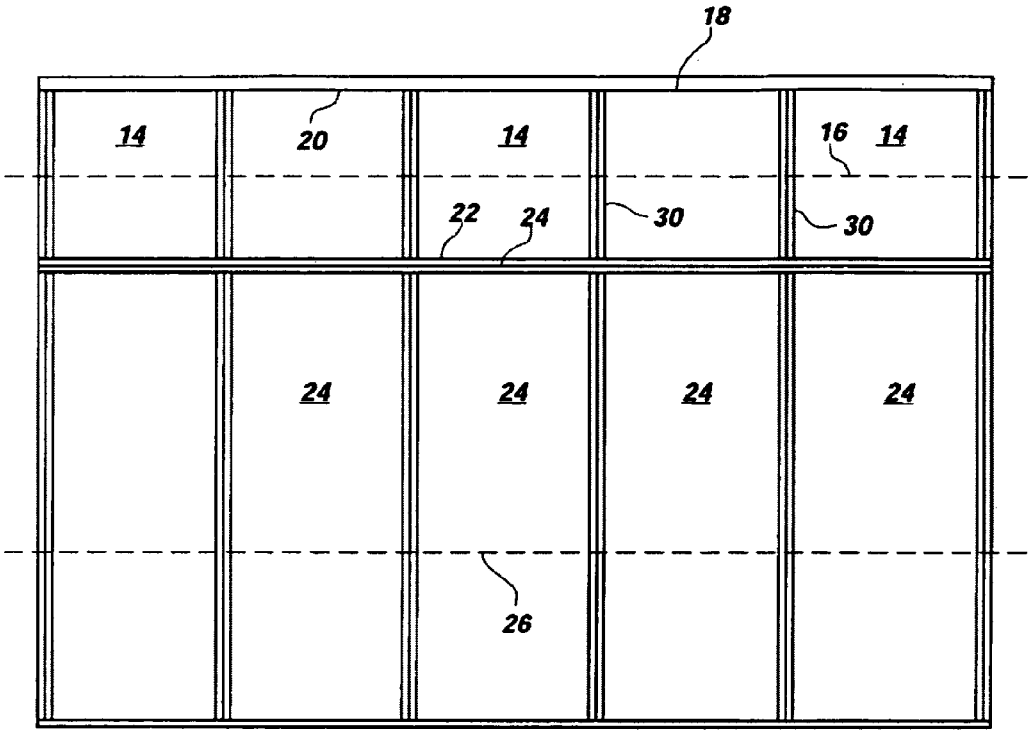
Fig. 1 (PRIOR ART)
FIG. 1 is a front view of a prior art wall construction.

As shown in FIG. 1, a clean room wall panel assembly extant in the art includes a plurality of first panels 14 which are arranged contiguously side to side along a generally linear axis 16 oriented parallel to the ceiling header 18. The uppermost side 20 of each of the first panels 14 engages with the header 18. The opposing side 22 of each first panel 14 engages with a respective second panel 24 which is positioned elevationally below its respective first panel 14. The plurality of second panels are arranged contiguously side to side to form a linear array which extends along a second linear axis 26. Each of the joints or intersections between adjacent first panels, between adjacent first panels and second panels and between adjacent second panels is reinforced by a stiff batten stud element 28. As shown to advantage in FIG. 1 first battens 28 extend to cover the intersection of all of the first panels with their respective second panels. Individual battens 30 are positioned over the intersection of each pair of adjacent first panels. Individual battens 32 are positioned over the intersection of each pair of adjacent second panels 24. It is important to note that in many instances the battens are positioned on both sides of the wall. While the use of battens provides some degree of enhanced structural integrity to these extant wall panel assemblies, the structural strength of such batten reinforced wall assemblies remains below industry expectations. Furthermore, the amount of labor, time and expense created by the construction and installation of the battens has rendered this particular construction technique undesirable. Of most concern is the tendency of such battens to collect dust and other air borne debris. Given that a principal function of clean rooms is to provide a contaminant free environment, notably a dust free environment, the presence of the battens complicate the maintenance of such an environment.

Pursuant to the instant invention in FIG. 2, a ceiling header 36 is associated with a plurality of individual first panels 38 which are positioned elevationally below the ceiling header 36. In a preferred construction each of the first panels 38 is suspended from the ceiling header 36 by a respective connection member described hereinafter.

The ceiling header 36 is formed of an elongate extrusion which defines a slot-like opening 39 in its lower edge. Positioned medially within the structure of the head 36 is a laterally extending slot 40. The slot is dimensioned to slidingly receive and retain a "T"-shaped bracket element 42. Element 42 includes a shaft like portion 44 which extends downwardly when the element is positioned within the slot 40. The shaft like portion defines a threaded aperture there through which is dimensioned to threadingly receive a threaded bolt 46. An elongate bracket 48 is interconnected to the bracket element 42. The bracket 48 defines a threaded aperture 50 there through in one end of the bracket which is dimensioned to threadingly receive the threaded bolt 46. In alternative constructions, a threaded nut 50A may be secured to the exterior surface of the bracket 48. The nut 50A defines a threaded aperture therethrough which is positioned to receive and threadingly receive the threaded shaft of bolt 46. The threaded nut 50A provides a means of securing the bracket element 42 to the bracket 48 without the need for threading aperture 50.

Figure 9:
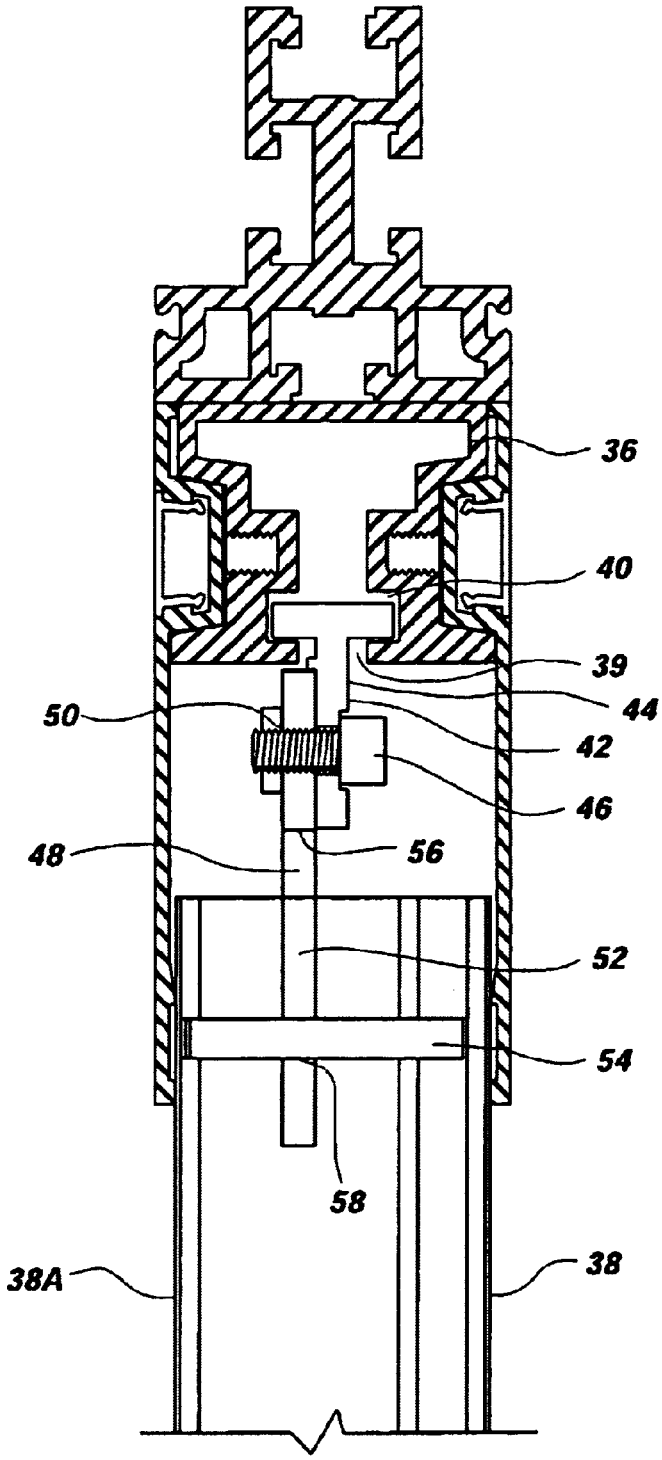
FIG. 9 is a cross sectional view of the first wall panel and supporting ceiling structure of FIG. 8 taken along section line 6—6 shown in an alternative orientation.
Figure 12:
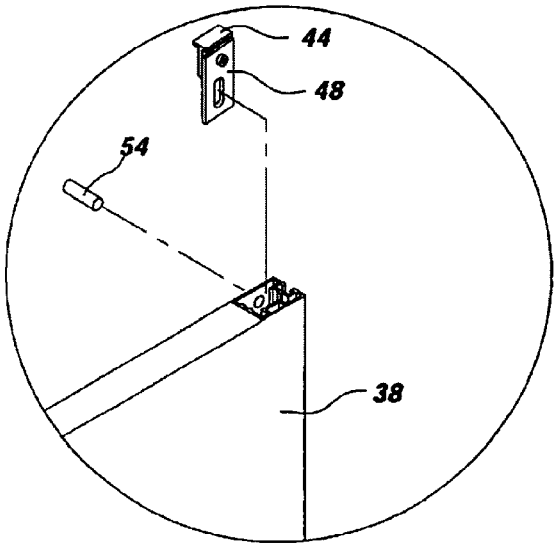
FIG. 12 is a partial perspective view of the top region of a wall panel of the invention with an exploded view of the ceiling securement structure.

The opposing end of the bracket 48 defines an elongate slot 52 which is dimensioned to slidingly receive a drive pin 54. As shown in FIG. 9, the drive pin 54 is secured to the panel 38 by means of a threaded engagement into a female threaded fitting 55 which is mounted to the interior upright surface of the first panel wall 38. The opposing end of the drive pin 54 may be received within an aperture defined in the opposing sidewall 38A of the first panel wall 38

Figure 10:
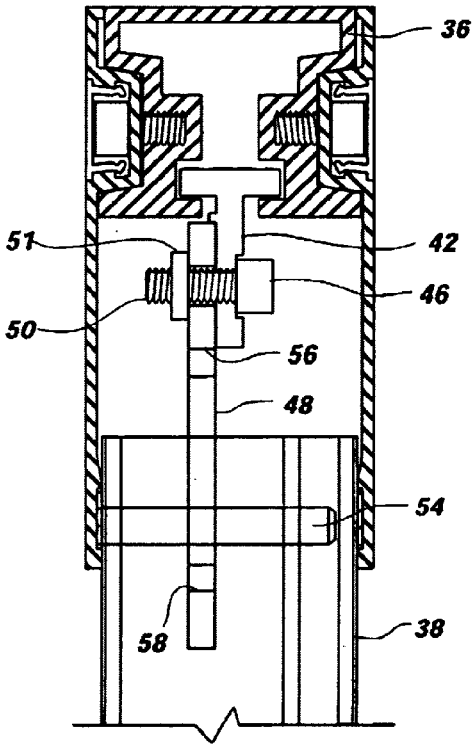
FIG. 10 is a partial sectional view of the supporting ceiling structure of FIG. 9 shown in a first condition.
Figure 11:
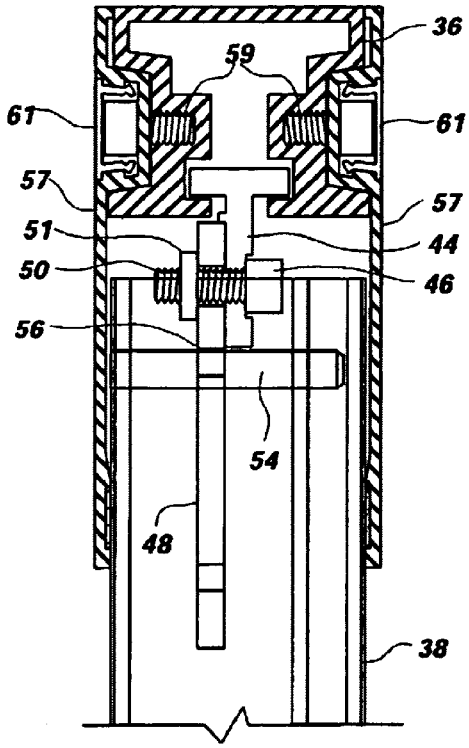
FIG. 11 is a partial sectional view of the supporting ceiling structure of FIG. 9 shown in a second condition.

The slot 52 extends between an upper slot edge 56 and a lower slot edge 58. The slot is dimensioned and configured to permit the drive pin to be displaced between the edge 56 and the slot edge 58. As a result the slot permits the panel 38 to be displaced upward until the pin 54 contacts the upper slot edge 56 and downwardly until the pin 54 contacts the lower slot edge 58. The interaction of the pin 54 with the slot permits the header 36 to be displaced either upwardly or downwardly within a certain distance without causing a corresponding displacement by the wall panel 38. In many instances, the ceilings or roof structures are exposed to the environment. Should a weight load be applied to the roof of the clean roof, e.g. by an accumulation of snow, the ceiling of the clean room may be displaced downwardly a preselected distance without the weight of the ceiling being applied directly to the wall 38 in that according to the instant invention, the header 36 would simply be displaced as the slot 52 was displaced downwardly thereby causing the location of the pin 54 within the slot 52 to approach the upper edge 58. The present structure therefore facilitates the deflection of a clean room ceiling without adversely effecting the wall below. FIG. 10 illustrates the ceiling support structure with the pin 54 being positioned proximate the lower edge 58 of the bracket 48. This condition would likely be the normal operating condition of the ceiling support assembly. FIG. 11 illustrates a downward deflection of the ceiling of the clean room resulting in the bracket 48 being displaced downwardly. The downward displacement of the bracket 48 results in the pin 54 being positioned proximate the upper edge 56 of the slot 52. Until the pin 54 actually contacts the upper edge 56 little if any force is applied to the wall 38 by the ceiling header 36. It follows that the header may be displaced a distance corresponding to the length of the slot 52 without causing any substantial force application to the wall 38.

In an alternative construction the drive pin 54 is driven through a snug opening 60 in a respective first panel 38. The panel 38 therefore is suspended from the ceiling bracket 36 through means of the assembly formed by the bracket 44 and the bracket 48.

Figure 13:
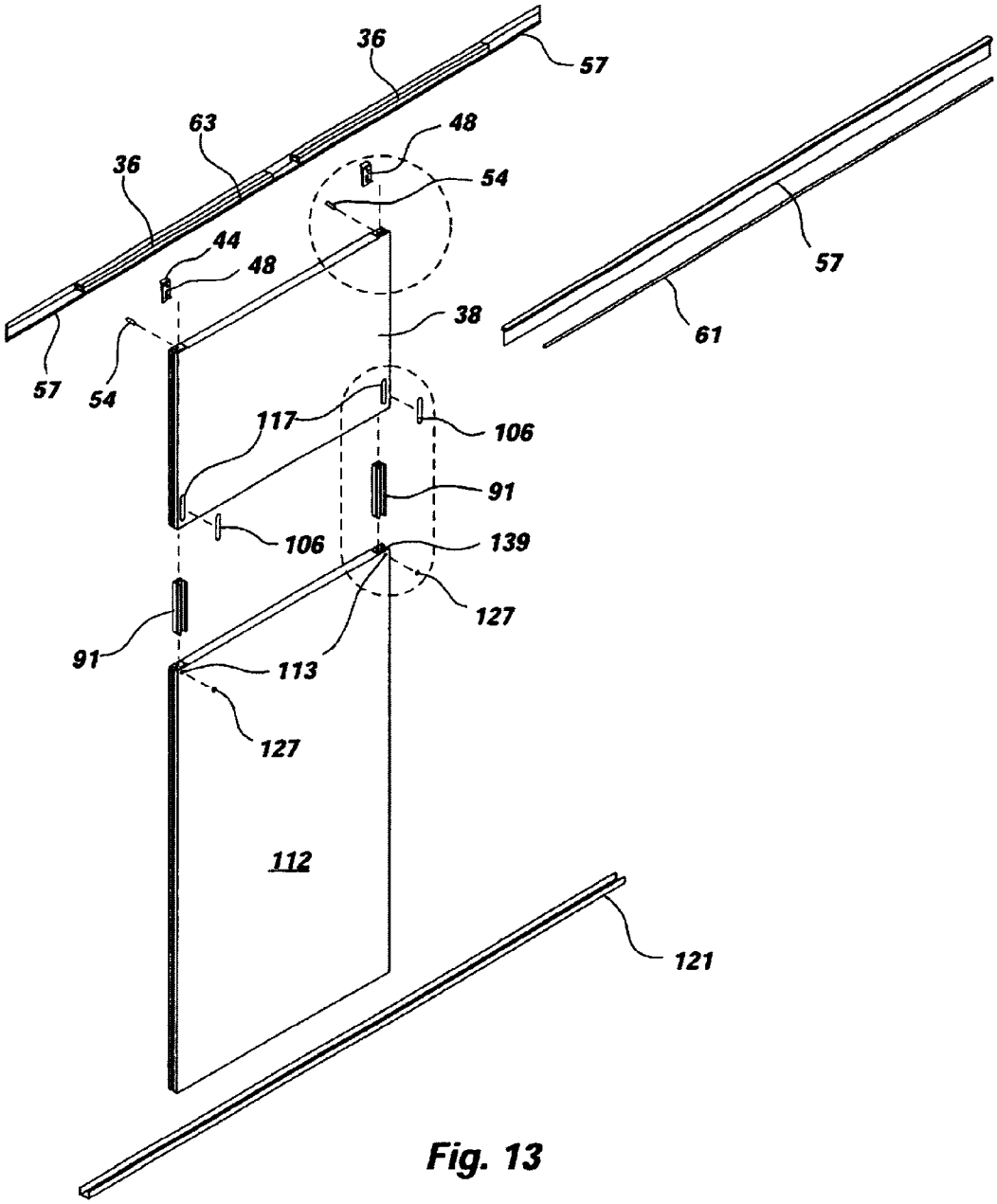
FIG. 13 is an exploded perspective view of a wall panel assembly of the invention.
Figure 14:
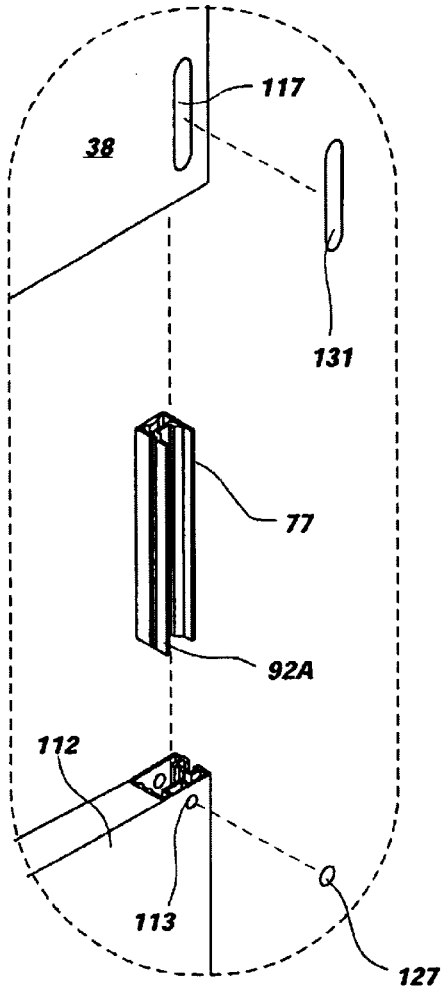
FIG. 14 is a partial exploded view of the interpanel securement structure of the invention.

The ceiling header 36 maybe attached to the roof structure of the clean room by conventional means. As shown in FIG. 13, an extruded head track 63, formed of measured lengths of track which are spacedly positioned from another along a linear alignment may be intercooperated with the headers 36 to constitute an installation structure. The head track 63 may then be secured directly to the roof of the clean room. The header 36 and the head track 63 may be covered on their upright sides by one or more battens 57 which are secured to the header 36 by means of threaded bolts 59. The bolts 59 may be hidden from view by means of cover elements 61 which are received and pressure fit retained within depressions defined within the sidewall of the battens 57.

Figure 3:
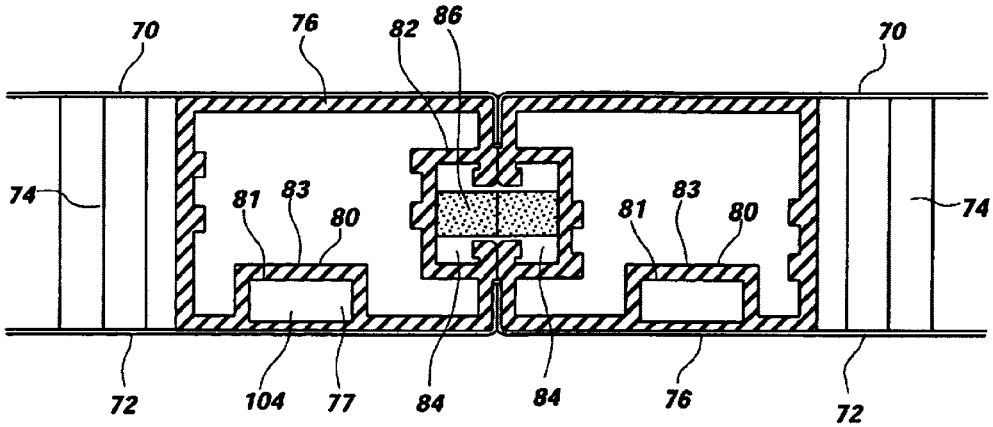
FIG. 3 is a cross sectional view of the assembly of FIG. 2 taken along section line 6—6.

As shown in FIG. 3, the first panel 38 is formed of two planar panels 70 and 72. Each of these panels defines a generally quadrilaterally configured perimeter. The panels are positioned parallel and spacedly apart from one another. Interposed between the two panels is a honeycomb configured element 74 which is typically fabricated from a lightweight material. The two panels 70 and 72 are secured to the element 74 to form an integrated panel assembly. An elongate extruded member 76 is disposed on the upright end of the first panel 38. As shown in FIG. 3 this member 76 defines a generally quadrilaterally configured cross section. The member 76 further defines two inwardly directed sections 77 and 82. The first inwardly directed section 77 defines a plurality of upstanding sidewalls which are associated one with another to form a box-like structure which extends into the hollow interior of the member 76. One sidewall 81 of the upstanding sidewalls defines an aperture there through dimensioned to threadingly receive a threaded bolt 92.

Positioned within the hollow interior of the extruded member 76 are two elements 88 and 90 which, in association, form an interconnection assembly 91. Each of these two elements is an elongate member which extends a preselected distance along the height of the panel 38. The element 90 defines one or more slot like channels 100. These channels may be positioned on opposing sides of the element. Each of these channels 100 is dimensioned to slidingly receive a corresponding extension or ear 101 which extends outwardly from the structure of the element 88. The interaction of the ears 101 and the channels 100 tend to confine the displacement of the two element 88 and 90 relative to one another to displacements along a linear axis parallel to the longitudinal axes of the two elements. Each of the channels 100 have a laterally measured width which is greater than the width of its corresponding ear 101 thereby permitting a lateral displacement of the element 88 with respect to the counterpart element 90. The element 90 defines an aperture 94 there through which is dimensioned to receive the threaded portion of the bolt 92. A nut like element 96 is secured to the element 90 proximate the aperture 94. The element 96 is configured to threadingly receive the bolt 92. The element 88 defines an abutment area 98 which is positioned opposite the positioning of the aperture 94. As the bolt 92 is threadingly inserted into the aperture 94 the end of that bolt subsequently comes into abutment against the abutment area 98. As the bolt 92 continues to be driven through the element 96, the bolt causes the element 88 to be displaced in the direction indicated by arrow 102. Furthermore, the same action of the bolt 92 causes the element 90 to be driven in the direction of arrow 103. As the bolt is further driven through the element 96, the two elements 88 and 90 are pushed out laterally from one another into engagement against the interior sidewalls of the extrusion 76 eventually forming a pressure union with that extrusion. To disengage this pressure union, the rotation of the bolt 92 is reversed. The slot 104, which provides access to the bolt 92, may be covered by a pressure fit cover element 106 for aesthetic purposes. In preferred constructions, the interconnection assembly 91 includes a plurality of bolt 92 assemblies as described, spaced along the height of the assembly 91. These bolt assemblies 92 are positioned in alignment with the apertures 117 and 113 defined in the sidewalls of panels 38 and 112 whereby the bolts 92 may be accessed through the apertures by means of a wrench, e.b. an Allen wrench, configured to interact with the head of the bolts 92.

The second box like structure 84 which extends into the interior of the extrusion 76 is disposed on the end wall of the panel 38. The structure 84 is positioned to align with a similar structure 84 defined within an adjacently positioned first panel 38. The structure 84 is dimensioned to receive and retain a sealing structure 86 which is adapted to provide a measure of stability to the interface of the two panels 38. The connection member 86 also forms a gasket seal between abutting panels.

Figure 4:
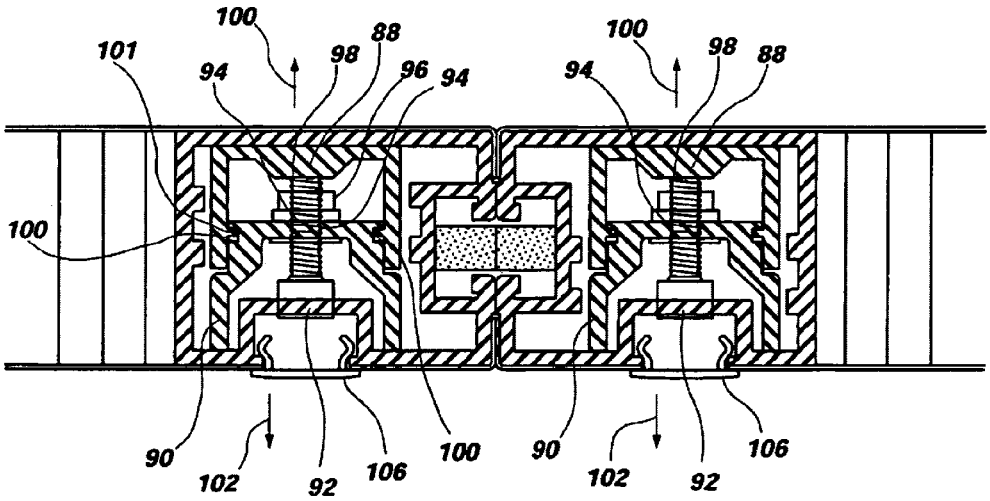
FIG. 4 is a cross sectional view of the assembly of FIG. 2 taken along section line 2—2.

As shown in FIG. 4, adjacently positioned panels 38 may include sealing structures 86 on opposing sides of the panels. Placement of the structures 86 is largely determined by the particular structural configuration of the site in which the wall structure is to be erected.

Figure 5:
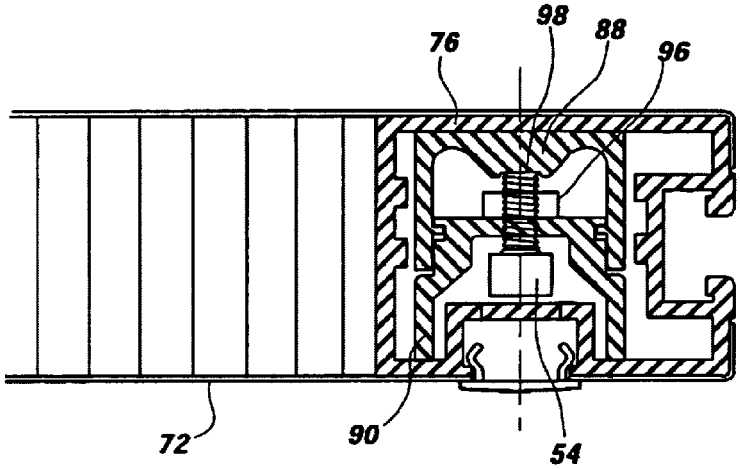
FIG. 5 is a cross sectional view of the assembly of FIG. 2 taken along section line 3—3 having expansion element collapsed.
Figure 6:
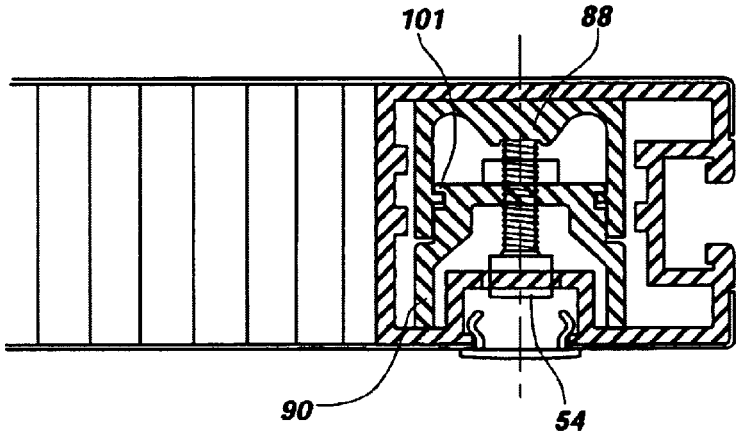
FIG. 6 is a cross sectional view of the assembly of FIG. 2 taken along section line 4—4 having expansion element expanded.
Figure 7:
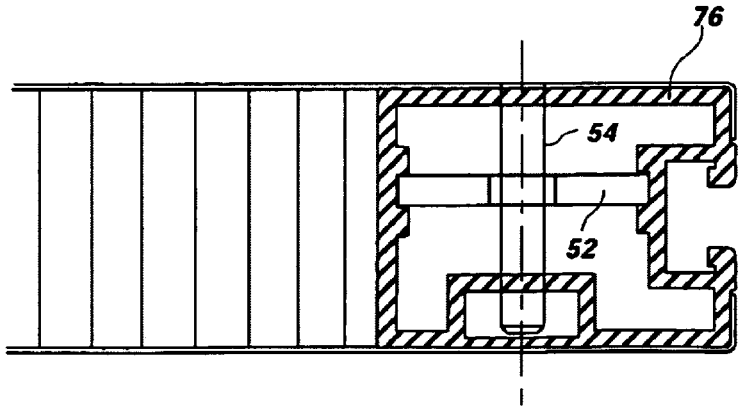
FIG. 7 is a cross sectional view of the assembly of FIG. 2 taken along sectional line 5—5.
Figure 8:
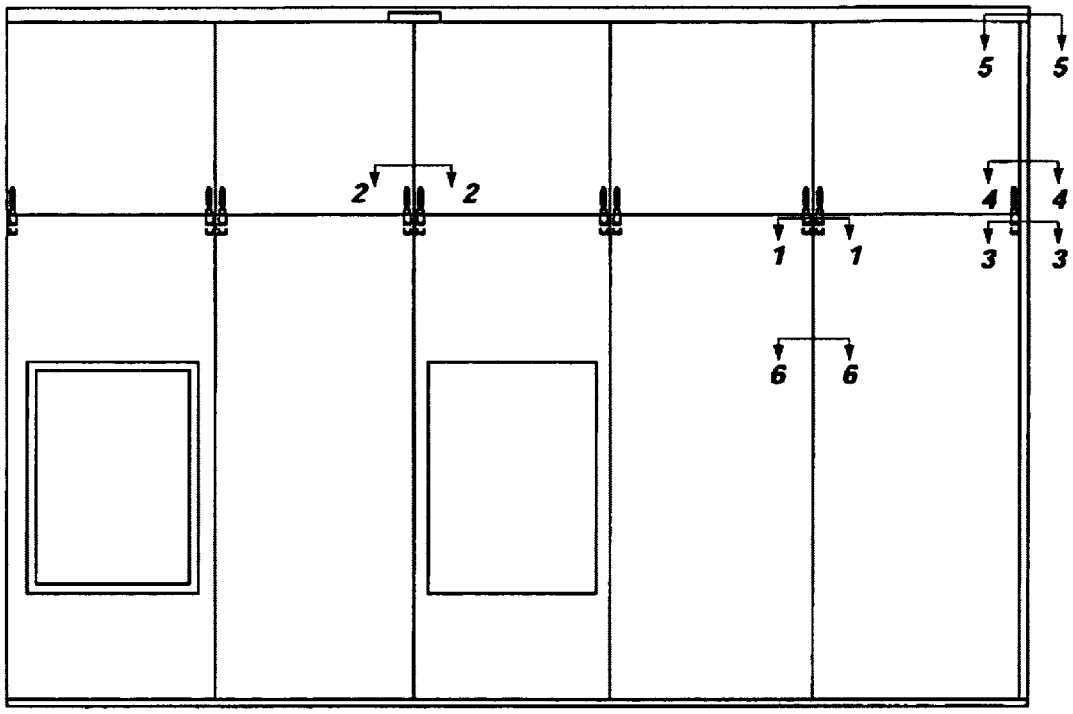
FIG. 8 is an elevation view of the wall panel assembly of FIG. 2 showing internal expansion elements.

FIG. 5 illustrates the interconnection assembly in a collapsed condition wherein the lateral dimension of the assembly 91 is minimized thereby permitting the assembly to freely slide within the channel formed within the hollow interior of the extrusion 76. In this particular condition, the ears 101 are in abutment against foremost edge of the channel 100 of the element 90. FIG. 6 illustrates the expanded condition of the assembly 91 wherein the assembly 91 achieves its maximum lateral dimension and thereby forms a pressure fit union against the internal sidewalls of the extrusion 76. Notably in this condition the ears 101 are abutted against the opposite edges of the channel 100. Note in FIG. 6 the bolt is longer than the bolt in FIG. 5. One of the bolts is longer to engage the slot so the connector can move up and down but not fall out.

Figure 2:
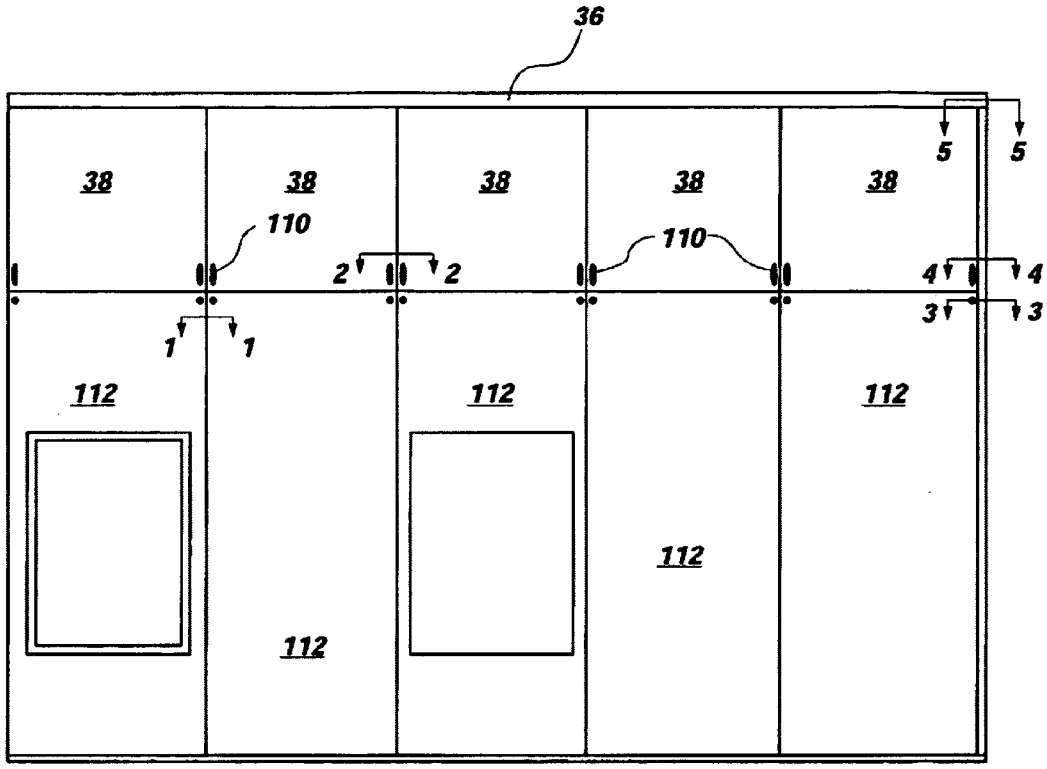
FIG. 2 is a front view of a wall panel assembly of the instant invention.

As noted in FIG. 2 each of the panels 38 define an elongate slot 117 which extends vertically through the sidewall panel 72. These slots 117 are dimensioned to permit the user to access the bolts 92 of the interconnection assembly 91. It follows that in an assembled condition the bolt 92 is located in the upper reaches of the slot 110. Once a counterpart second panel 112 is positioned in alignment below its first panel 38 so as to position in registration the open channel of its extrusion 116, the bolt 92 may then be rotated to disengage the pressure union of the assembly 77 against the internal sidewalls of the-extrusion 76. Thereafter the assembly may descend through the hollow interior of the extrusion 76 such that a portion of the assembly enters the open channel of the extrusion 116. The open channel of the extrusion 116 may be fitted with structure which extends into the channel to engage against the exterior sidewall of the interconnection assembly to form a pressure fit therewith and thereby restrict the depth to which the assembly 91 may pass into the open channel of the extrusion 116. Note there is an aperture 113 in the bottom panel 112 dimensioned to permit the user to access the bolt 92A at the lower portions of the connector assembly 91 (see FIG. 2). Once the assembly has descended a preselected distance downward through the extrusion 76, the bolts 92 may again be rotated to produce a lateral expansion of the assembly and a pressure fit union of the assembly with the extrusion 76. With the assembly in this latter position, the first and second panels are interconnected one to another with a sufficient level of integrity to retain the two panels in a fixed relationship relative to one another.

Figure 15:
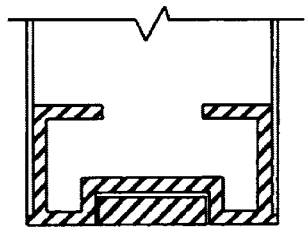
FIG. 15 is a cross sectional view of a first base track embodiment.
Figure 16:
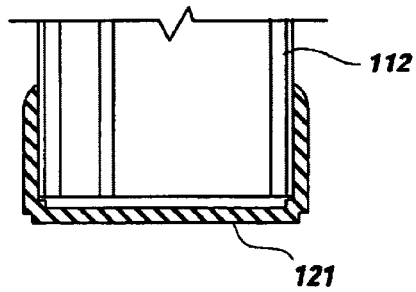
FIG. 16 is a cross sectional view of a second base track embodiment.

The panels 112 are dimensioned to be received and retained within bottom track members 121 as illustrated in FIG. 16. The bottom tracks 121 are adapted to be secured to the floor structure of the clean room consistent with conventional practice. FIG. 15 illustrates an alternative base track configuration.

Should the user wish to remove a panel 112, the user simply removes the cover plug 127 and the closure plug 131 to access the various bolts 92. Unscrewing the bolts 92 causes the assembly 91 to laterally contract thereby disrupting the pressure fit union which secured that assembly to the interior sidewalls of the respective channels of each of the panels 112 and 38. Once the assembly has been freed, it may be slid upwardly through the channel 136 of panel 38 until its lower end clears the channel 139 of the panel 112. Once the assembly 91 has cleared the lower channel, the upper panel 38 may be raised slightly to permit the lower panel 112 to be raised and disengaged from its base track. Thereafter, the panel 112 may be removed from its positioning by inclining the panel slightly and thereafter pulling the panel 112 outwardly. Since the panel 112 is not connected to the panels 112 positioned on either side of it, the panel 112 may be removed without interrupting the two adjacent panels 112.

Similarly, the panel 38 may be removed after disengaging the interconnection assembly 91 from its association with the lower panel 112 by unscrewing bolt 46 from its association with nut 51. Thereafter, one or more of the battens 57 may be removed to permit the panel 38 to be laterally pulled out of the wall assembly. Again, since the panel 38 is not physically connected to the adjacently positioned panels 38, the panel 38 may be removed without disrupting the positioning of the adjacently positioned panels 38.

The instant wall structure provides a wall assembly which is demountable. Given the particular arrangement, individual wall panel may be removed without removing any other wall panel. It follows that wall assembly provides the user with a means of readily modifying the wall assembly consistent with user needs as they developed. Accommodation to changing needs for the room's configuration may be achieved with a minimum of disruption to the wall structure. Furthermore, the instant assembly provides a wall assembly which has sufficient stiffness that it will satisfy the UBC code section 1611.5 requirements. Given the manufacturing limitation of conventional break presses to sheet metal widths of approximately 13 feet, the instant invention provides a means of manufacturing a wall assembly of between 12 and 18 feet with sufficient stiffness to meet established code requirements. The instant wall assembly is preferably manufactured from aluminum due to its light weight and resistance to rust should it be scratched.

It is to be understood that the description of the various illustrated embodiments are merely illustrative of the various concepts of the invention. The essence of the invention is more throughly disclosed in the claims which are appended hereto.

What is claimed is:

1. A panel assembly comprising:

a first panel having a first inner sidewall defining a first passageway, said first panel defining a slot which communicates said first passageway with an environment;

a second panel having a second inner sidewall defining a second passageway and said first passageway being in alignment with said second passageway, said first panel being positioned elevationally above said second panel; and a connection member for interconnecting said first panel to said second panel, said connection member being slidingly disposed in said first passageway and slidingly disposed partially in said second passageway, said connection member being dimensionally expandible to engage against said first sidewall and produce a pressure fit with said first sidewall;

wherein said connection member includes a first elongate member which defines a threaded opening therethrough;

a second elongate member which defines an abutment area; and a first interconnection member for interconnecting said first elongate member to said second elongate member; said first interconnection member being operative to adjust a spatial orientation of said first elongate member relative to said second elongate member, said first interconnection member being a threaded bolt which is threadedly inserted through said threaded opening.

2. A panel assembly comprising:

a first panel having a first inner sidewall defining a first passageway, said first panel defining a slow which communicates said first passageway with an environment;

a second panel having a second inner sidewall defining a second passageway and said first passageway being in alignment with said second passageway, and a connection member for interconnecting said first panel to said second panel, said connection member being slidingly disposed in said first passageway and slidingly disposed partially in said second passageway, said connection member being dimensionally expandible to engage against said first sidewall and produce a pressure fit with said first sidewall;

wherein said connection member includes a first elongate member which defines a threaded opening therethrough;

a second elongate member which defines an abutment area; and a first interconnection member for interconnecting said first elongate member to said second elongate member; said first interconnection member being operative to adjust a spatial orientation of said first elongate member relative to said second elongate member, said first interconnection member being a threaded bolt which is threadedly inserted through said threaded opening wherein said first passageway sais and second passageway share a common vertical axis.

3. The panel assembly of claim 1, wherein said first interconnection member is operative to adjust a lateral spacing of said first elongate member from said second elongate member.

4. The panel assembly of claim 1, wherein said first elongate member has a first longitudinal axis and said second elongate member has a second longitudinal axis wherein said first longitudinal axis is oriented parallel to said second longitudinal axis.

5. The panel assembly of claim 4, wherein said first interconnection member is operative to adjust a spacing of said first longitudinal axis relative to said second longitudinal axis.

6. The panel assembly of claim 1, wherein said first interconnection member is positioned physically accessible through said slot.

7. The panel assembly of claim 2 wherein said first panel is positioned elevationally above said second panel.

8. The panel assembly of claim 1 further including a second interconnection member for interconnecting said first elongate member to said second elongate member, said second interconnection member being disposed to be physically accessible through said slot in a first condition and physically inaccessible through said slot in a second condition.

9. The panel assembly of claim 8, wherein said first interconnection member is positioned elevationally above said second interconnection member.

10. The panel assembly of claim 7 wherein a length of said slot is dimensionally larger than a distance between said first interconnection member and said second interconnection member.

11. The panel assembly of claim 1, further comprising a plurality of first panels and a plurality of second panels, each first panel being physically associated with a respective second panel, and each said first panel being positioned adjacent another said first panel.

12. The panel assembly of claim 1, wherein each said first panel defines a first surface and a second surface, said first surfaces being oriented to face in a first direction and said second surfaces being oriented to face in a second direction.

13. The panel assembly of claim 1, wherein said first passageway is formed by a hollow elongate extrusion.

14. The panel assembly of claim 1, wherein said slot in a primary said first panel is defined in a first surface of said primary first panel and a respective said slot in a secondary first panel positioned adjacent said primary first panel is defined in said second surface of said secondary first panel.

15. The panel assembly of claim 1 wherein said second panel defines a secondary slot therein which communicates said second passageway with said environment.

16. The panel assembly of claim 7 wherein said second panel defines a secondary slot therein which communicates said second passageway with said environment, said second interconnection member being accessible through said secondary slot.

17. The panel assembly of claim 1 further including a second connection member for interconnecting said first elongate member to said second elongate member.

18. A panel assembly comprising:

a first panel having a first inner sidewall defining a first passageway, said first panel defining a slot which communicates said first passageway with an environment;

a second panel having a second inner sidewall defining a second passageway and said first passageway being in alignment with said second passageway; and a connection member for interconnecting said first panel to said second panel, said connection member being slidingly disposed in said first passageway and slidingly disposed partially in said second passageway, said connection member being dimensionally expandable to engage against said first sidewall and produce a pressure fit with said first sidewall;

wherein said connection member includes a first elongate member which defines a threaded opening therethrough;

a second elongate member which defines an abutment area; and a first interconnection member for interconnecting said first elongate member to said second elongate member; said first interconnection member being operative to adjust a spatial orientation of said first elongate member relative to said second elongate member, said first interconnection member being a threaded bolt which is threadedly inserted through said threaded opening wherein said threaded opening, said abutment and said threaded bolt are disposed such that a rotation of said threaded bolt in a first direction causes an increase in a distance separating said threaded opening and said abutment and together with a resulting increase in a spatial distancing of said first elongate member from said second elongate member eventually resulting in a pressure fit of said first elongate member and said second elongate member with said sidewall defining said first passageway.

19. The panel assembly of claim 18 wherein a rotation of said threaded bolt in a second direction causes a decrease in said distance separating said threaded opening and said abutment area resulting in a release of said pressure fit.

20. The panel assembly of claim 19, wherein said spatial distancing of said first elongate member from said second elongate member is a lateral distance.

* * * * *